United States Patent [19]

Collins

[11] 4,075,716

[45] Feb. 28, 1978

[54] DISPOSABLE GARMENT WITH RETAINED BELT ASSEMBLY

[75] Inventor: Robert F. Collins, Barrington, Ill.

[73] Assignee: The Kendall Company, Boston, Mass.

[21] Appl. No.: 683,989

[22] Filed: May 6, 1976

Related U.S. Application Data

[63] Continuation-in-part of Ser. No. 542,999, Jan. 22, 1975, Pat. No. 3,987,518.

[51] Int. Cl.[2] ..... A41B 9/00

[52] U.S. Cl. ..... 2/114; 2/DIG. 7

[58] Field of Search ..... 2/114, 51, 300, 338, 2/69.5, 93, 155, 156, DIG. 7, 338; 206/440

[56] References Cited

U.S. PATENT DOCUMENTS

| | | | |
|---|---|---|---|
| 2,402,981 | 7/1946 | Beal et al. | 2/DIG. 7 |
| 3,129,432 | 4/1964 | Belkin | 2/114 |
| 3,359,569 | 12/1967 | Rotanz et al. | 2/114 |
| 3,570,012 | 3/1971 | Winters | 2/114 |
| 3,594,818 | 7/1971 | Planner | 2/114 |
| 3,648,290 | 3/1972 | Hartigan | 2/114 |
| 3,721,999 | 3/1973 | Goya et al. | 2/DIG. 7 |
| 3,754,284 | 8/1973 | Hartigan et al. | 2/338 X |
| 3,803,640 | 4/1974 | Ericson | 2/114 |

*Primary Examiner*—Werner H. Schroeder
*Assistant Examiner*—Moshe I. Cohen
*Attorney, Agent, or Firm*—Powell L. Sprunger

[57] ABSTRACT

A disposable garment comprising, a sterile gown having a back, a pair of side edges defining an opening on the back of the gown, and an elongated belt retained on the gown and having at least one end section for placement around the opening to close the gown about a wearer. The garment has a protective member removably positioned on and covering an outer end of the one end section to prevent contamination of the one end section while handling the belt. The protective member is releasably retained against the garment to prevent premature movement of the protective member relative the gown.

18 Claims, 20 Drawing Figures

DISPOSABLE GARMENT WITH RETAINED BELT ASSEMBLY

CROSS-REFERENCE TO RELATED APPLICATION

The present application is a continuation-in-part of application Ser. No. 542,999 now U.S. Pat. No. 3,987,518, filed Jan. 22, 1975, incorporated herein by reference.

BACKGROUND OF THE INVENTION

The present invention relates to garments, and more particularly to disposable gowns.

Disposable gowns, such as operating room gowns, are generally made with an open back to prevent possible contamination to the critical sterile gown front. It is also desirable to maintain the gown back sterile since the wearer of a contaminated gown may contact the sterile gown front of another person with the gown back, thus contaminating the gown front of the second person. The gowns are provided with various devices for closing the gown, such as a belt. According to a preferred procedure, after the surgeon or other user dons the gown, he grasps one end of the belt which is positioned for easy access to the surgeon's hand, while the other end of the belt is brought around the opposite side of the gown by another person in the operating room, such as a nurse. After being handed the other end of the belt, the surgeon ties the ends of the belt to close the gown. Since it is desirable that the nurse may handle the other belt end without requiring that her hands be sterile, the outer end of the other belt end is normally covered by a protective member to prevent contamination to the gown belt during handling. After the nurse hands the other belt end to the surgeon, the protective member is pulled off the belt by the nurse.

Although the procedure for placing the gown is satisfactory in theory, certain difficulties have been encountered during placement of the gown resulting from possible contact of the protective member against the wearer's back. Thus, when the gown is being placed on the wearer, the protective member may touch the wearer's shirt before an opening on the gown back has been fully closed, causing contamination of the protective member before it has been grasped by the nurse for securing the gown about the wearer. If the protective member subsequently contacts the gown back, it must be assumed that the gown back has been rendered non-sterile. Accordingly, in this case, the first gown should be removed, and the procedure must be started anew with a second sterile gown.

SUMMARY OF THE INVENTION

A principal feature of the present invention is the provision of a disposable sterile garment which minimizes the possibility of contamination to a back of the garment.

The garment of the present invention comprises, a sterile gown having an inner surface, an outer surface, a front, a back, a pair of side edges defining an opening on the back of the gown, and a protective flap defined by a fold line generally aligned with one of the side edges. The flap is folded against an underlying portion of the gown with the outer surface of the flap facing the outer surface of the underlying portion of the gown. The garment has an elongated belt having a central portion attached to the gown and having a pair of end portions extending from the central portion for securing the gown about a wearer. One of the belt end portions extends from the belt central portion toward the one side edge of the gown, and the belt end portion is folded back along a fold line located adjacent the one side edge of the gown and defines an end section of the belt. The garment has a protective member removably positioned on and covering an outer end of the belt end section to prevent contamination of the end section while handling the belt. The protective member is located between the flap and the underlying portion of the gown and has an inner edge located intermediate the one side edge and the fold line of the gown. The protective member has an outer edge and a free grasping tab defined by a fold line generally aligned with the gown fold line. The garment also has means for releasably retaining the protective member against the garment.

A feature of the present invention is that the gown flap covers the protective member during initial placement of the gown to prevent contamination of the protective member.

Another feature of the invention is that the outer surface of the gown flap is shielded during initial placement of the gown preventing contamination to the outer surface of the gown flap.

Yet another feature of the invention is that the retaining means prevents dislodgement of the protective member during initial placement of the gown and retains it in its covered position beneath the gown flap.

Still another feature of the invention is that the retaining means prevents premature movement of the protective member relative the gown when the gown flap is unfolded during subsequent placement steps of the gown.

A feature of the invention is that the retaining means prevents movement of the initially sterile retaining member against the wearer's shirt before the gown opening has been fully closed, and thus prevents the protective member from being rendered non-sterile and contaminating the gown back prior to closure of the gown opening.

Yet another feature of the invention is that the grasping tab may be used to remove the protective member from the gown after the gown flap has been unfolded and the gown opening has been closed about the wearer.

Thus, a feature of the invention is that the gown flap and retaining means minimizes the possibility of contamination to the back of the gown.

Further features will become more fully apparent in the following description of the embodiments of this invention and from the appended claims.

DESCRIPTION OF THE PREFERRED EMBODIMENTS

Figure 1:
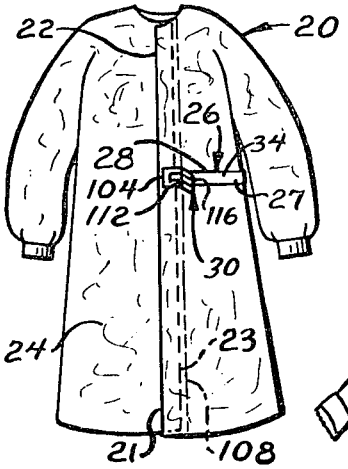
FIG. 1 is a perspective view of a disposable gown taken from the back of the gown and showing a belt assembly.
Figure 2:
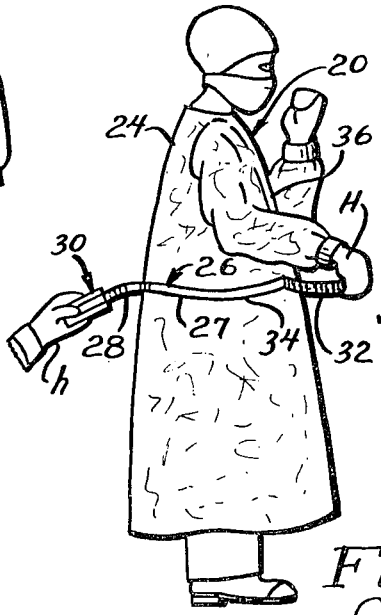
FIGS. 2–6 are perspective views illustrating steps taken by a wearer and an aide in placing the gown on a surgeon.

Referring now to FIG. 1, there is shown a disposable garment, such as an operating room gown, generally designated 20 having a pair of side edges 21 and 23 at side margins of the gown defining an opening 22 in the back 24 of the gown, and having a belt assembly generally designated 26. As shown in FIGS. 1 and 2, the belt assembly 26 has a belt 27 having a first end portion or section 28 extending from the gown back adjacent the opening 22, a second end portion or section 32 extending from the gown located adjacent the front 36 of the gown for grasping by the hand of a wearer, and an intermediate section 34 connecting the first and second end sections 28 and 32 and being secured to the gown. The belt 27 may be made of any suitable material such as Tyvek, a trademark of E. I. du Pont de Nemours, and in a preferred form the first and second end sections 28 and 32 of the belt are micropleated or microcreped such that they may be extended from a compacted configuration, as described in U.S. Pat. No. 3,754,284. As shown, the belt assembly 26 also has a protective member 30 covering an outer end of the first end section 28, and, as will be seen below, the protective member 30 is releasably attached to the gown.

Figure 3:
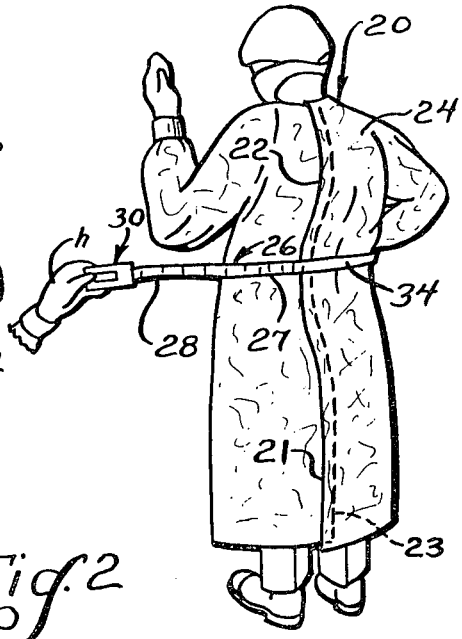
Figure 4:
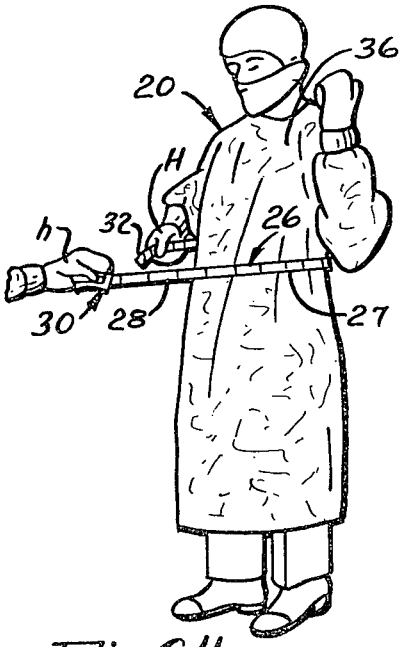
Figure 5:
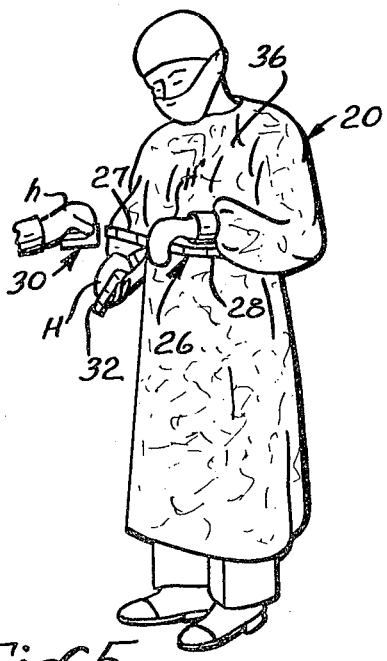
Figure 6:
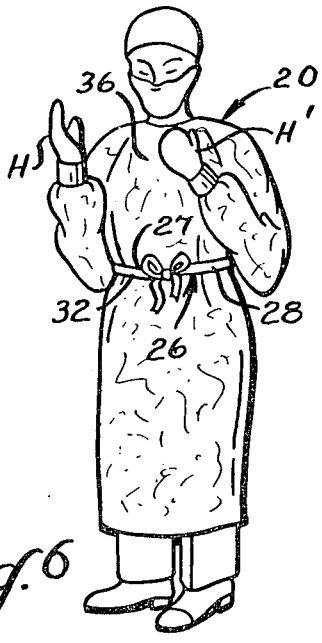

After the gown is properly unfolded and the wearer, such as a surgeon, dons the gown, the protective member 30 is released from the gown and is grasped by the non-sterile hand "h" of an aide, such as a nurse, while the second end section 32 is grasped by the sterile hand H of the surgeon. As shown in FIGS. 3 and 4, the nurse extends the compacted first end section 28 of the belt 27, and brings the outer end of the first end section 28 around the front 36 of the gown, after closing the opening 22 on the back of the gown 20. As shown in FIG. 5, the surgeon grasps the first end section 28 of the belt 27 with his other hand H', after which the nurse removes the protective member 30 from the first end section 28 of the belt. Finally, as illustrated in FIG. 6, the surgeon ties the first and second end sections 28 and 32 of the belt 27 to close the gown, thus completing placement of the gown 20 on the surgeon in a sterile manner.

Figure 7:
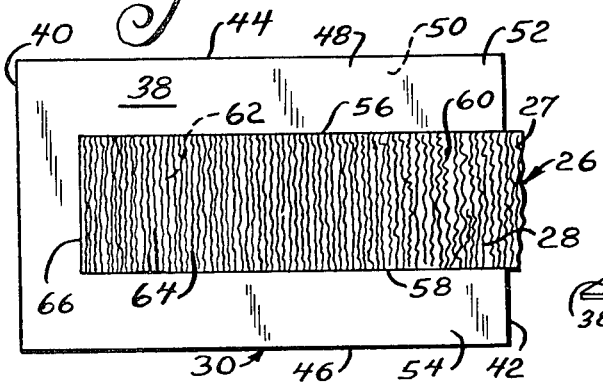
FIG. 7 is a fragmentary plan view of the partially formed belt assembly.

Referring now to FIG. 7, the protective member 30 comprises a sheet 38 of flexible material, such as paper, having a greater width than the belt 27, an outer end edge 40, a second inner end edge 42, a pair of side edges 44 and 46 connecting the end edges 40 and 42, an inner surface 48, an outer surface 50, and a pair of opposed side margins 52 and 54 extending past side edges 56 and 58 of the belt 27. An outer end 60 of the first end section 28 is positioned against the sheet 38 with a first surface 62 of the belt facing the inner surface 48 of the sheet, and with a second surface 64 of the belt facing away from the sheet 38. In the present embodiment, an outer end edge 66 of the belt may be spaced from the outer end edge 40 of the sheet 38, as shown.

Figure 8:
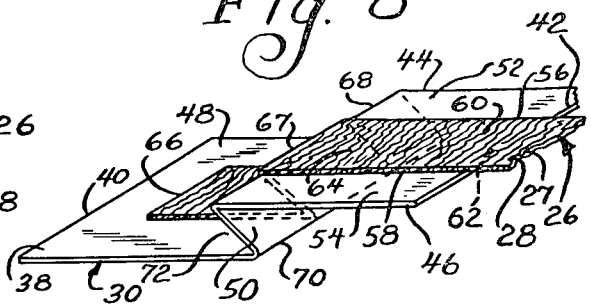
FIG. 8 is a fragmentary perspective view illustrating a step in the formation of the belt assembly.

As illustrated in FIG. 8, both the sheet 38 and outer belt end 60 have a lateral pleat or tuck 67 along laterally extending first and second fold lines 68 and 70, with the first fold line or edge 68 overlying the belt and the inner surface 48 of the sheet 38, and with the first fold line 68 being located intermediate the second fold line 70 and the outer end edge 40 of the sheet 38. The pleat 67 of the sheet 38 defines a pocket 72 facing toward the outer end edge 40 of the sheet 38, and receiving the pleated portion of the outer belt end 60. As will be seen below, in the preferred embodiment the pleats of the sheet 38 and belt 27 serve to releasably interlock or interleave the sheet and belt together, although the belt assembly may be used in the gown of the present invention without the interlocking or belt end retaining means.

Figure 9:
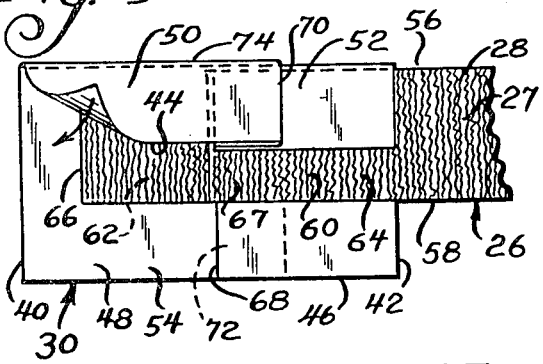
FIGS. 9–11 are fragmentary plan views illustrating further steps in the formation of the belt assembly.
Figure 10:
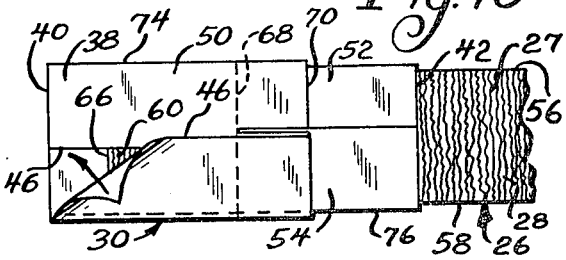

As shown in FIG. 9, one of the sheet side margins 52 is folded over the second surface 64 of the outer belt end 60, with the inner surface 48 of the side margin 52 facing the second surface 64 of the belt 28, and with the side margin 52 being folded along a longitudinally extending fold line 74 adjacent the side edge 56 of the belt 27. The width of the side margin 52 is preferably less than the width of the belt, such that the side edge 44 of the folded sheet 38 is located intermediate the side edges 56 and 58 of the belt. As shown in FIG. 10, the other side margin 54 is then folded along a longitudinally extending fold line 76 adjacent the side edge 58 of the belt, such that the side margin 54 overlaps the side margin 52, with the inner surface 48 of the side margin 54 facing the outer surface 50 of the side margin 52. Preferably, the width of the side margin 54 is less than the width of the belt 27, such that the side edge 46 of the sheet 38 is located intermediate the fold lines 74 and 76.

Figure 11:
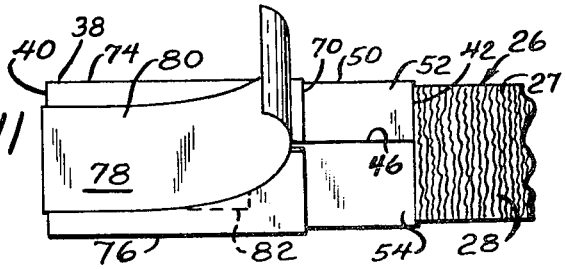

As shown in FIG. 11, the side margins 52 and 54 are secured together in their overlapped position by suitable means, such as a tape strip 78, or by adhesive as will be described below. The tape strip 78 has one end section 80 secured to the outer surface 50 of the side margins 52 and 54, such that the end section 80 extends on both lateral sides of the side edge 46 of the side margin 54. The tape strip 78 extends past and around the outer end edge 40 of the sheet 38, with a second end section 82 being secured to the outer surface of the sheet 38 on the other side of the protective member 30 and intermediate the fold lines 74 and 76. As will be discussed below, a portion of the end section 82 is folded back in order to releasably secure the protective member to the gown. The tape strip may be colored, if desired, to indicate that the protective member may be grasped by non-sterile hands.

Figure 13:
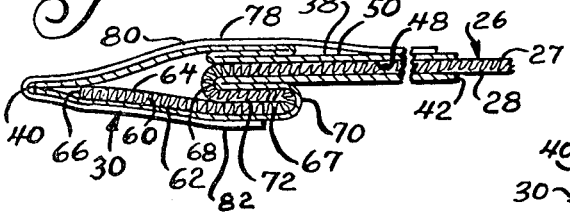
FIG. 13 is a sectional view taken substantially as indicated along the line 13—13 of FIG. 12.
Figure 12:
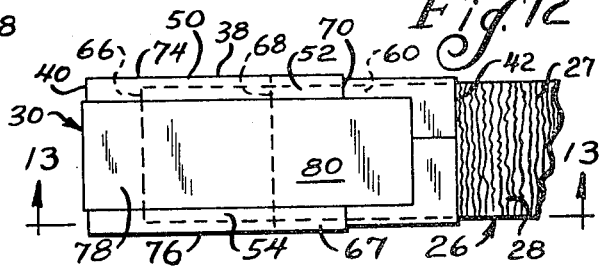
FIG. 12 is a fragmentary plan view of the belt assembly.

As shown in FIGS. 12 and 13, in this configuration the protective member 30 covers the outer end 60 of the belt 27 and protects it from contamination by the non-sterile hands of the nurse when the protective member 30 is handled. Since the end edge 66 of the belt 27 is spaced from the end edge 40 of the sheet 38, the edge is protected from contamination inside the protective member 30, and the tape strip 78 closes the outer end of the sheet 38 to further protect the outer belt end. As previously discussed, the pleat or tuck 67 formed by the lateral fold lines 68 and 70 serve to releasably interlock the outer end 60 of the belt 27 in the sheet 38 of the protective member 30. Accordingly, the interlocked pleats prevent premature release of the protective member 30 from the belt during handling of the protective member, and prevent possible contamination to the belt which may result if the released belt end contacts a non-sterile lower part of the gown. When the first end section 28 of the belt is brought into proper position by the protective member 30 for grasping of the belt by the surgeon, as previously described, the surgeon grasps the belt and the nurse may remove the protective member 30 from the belt by pulling on the protective member. The pleat of the belt 27 then unfolds from the pleat of the sheet 38 or unfolds the sheet pleat, or both, and the outer end 60 of the belt 27 passes out of the protective member 30.

Figure 14:
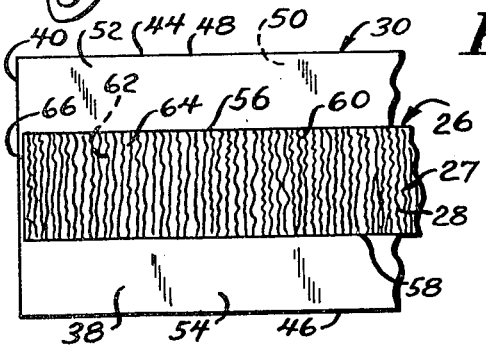
FIGS. 14 and 15 are fragmentary plan views of another embodiment of a partially formed belt assembly.
Figure 15:
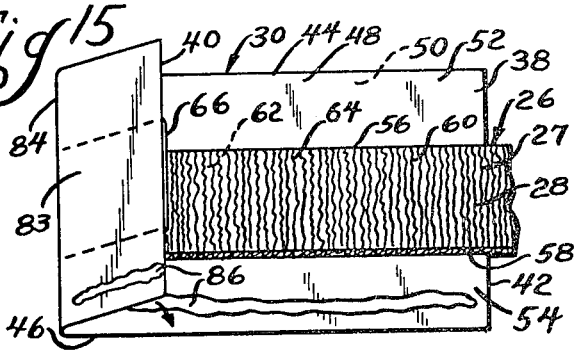

Another embodiment of the belt assembly is illustrated in FIGS. 14 and 15, in which like reference numerals designate like parts. In this embodiment, the end edge 66 of the outer belt end 60 is located in the proximity of the outer end edge 40 of the sheet 38. Also, in this embodiment, the outer end margin 83 of the sheet 38 and belt 27 are folded along a laterally extending fold line 84, such that the end margin 83 of the sheet and belt overlie the inner surface 48 of the sheet 38 and the second surface 64 of the one belt end 60 to ensure that the end margin of the belt 27 is protected from contamination during manipulation of the protective member 30. After the end margin 83 has been folded, as illustrated in FIG. 15, the belt and sheet are further folded in a manner similar to that described in connection with FIGS. 8–10, and the folded assembly may then be secured by the tape strip 78, if desired, as described in connection with FIGS. 11–13. Alternatively, as shown in FIG. 15, the side margin 54 of the sheet 38 may be secured to the outer surface 50 of the side margin 52 by a line of adhesive 86. It will be apparent that adhesive may also be used to secure the opposed side margins 52 and 54 of the protective member described in connection with FIGS. 7–13, if desired. It is also apparent that the end margin 83 of the belt 27 in the belt assembly described in connection with FIGS. 14 and 15 will readily pass out of the protective member 30 when the nurse removes the protective member from the belt.

Figure 16:
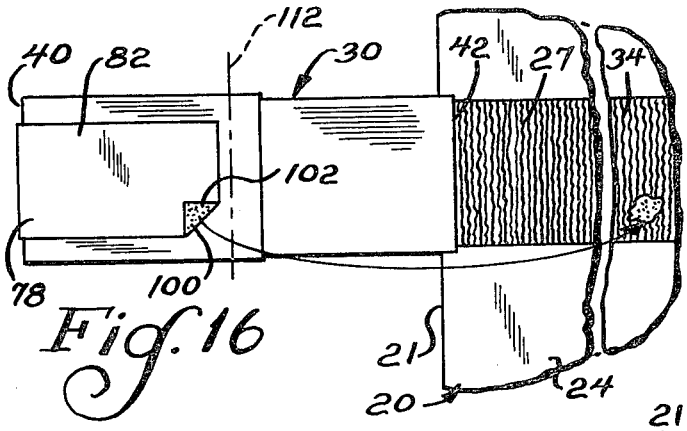
FIGS. 16—18 are fragmentary plan views illustrating further steps in the formation of the gown of the present invention.

The manner in which the belt assembly is releasably retained on the garment will be described as follows. With reference to FIG. 16, a corner or end portion 100 of the second strip end section 82 is folded over to expose adhesive 102 on the strip end portion 100. As shown, the inner edge 42 of the protective member 30 is located adjacent the side edge 21 of the gown back 24, and, with reference to FIGS. 16 and 17, the belt 27 is folded back along a lateral fold line 104 which is generally aligned with and located adjacent the gown side edge 21. In a preferred form, the inner edge 42 of the protective member 30 is located adjacent the fold line 104, such that the inner edge 42 of the protective member 30 is also located adjacent the side edge 21 of the gown 20. The protective member 30 is then pressed against the underlying part of the belt 27 or outer surface 106 of the gown 20, in order to releasably attach the protective member 30 to the garment by means of the adhesive 102 on the tape strip end portion 100. Next, with reference to FIGS. 17–19, the gown back 24 is folded along a fold line 108 which is generally aligned with and slightly spaced from the side edge 21 of the gown 20, thus defining a side flap 110 of the gown back having its outer surface 106 folded against the outer surface 106 of the underlying portion of the gown. At the same time, the protective member 30 is folded along a fold line 112 located adjacent and aligned with the fold line 108 of the gown, thus defining a grasping tab 116 extending between the fold line 112 and outer edge 40 at the outer end of the protective member 30. With reference to FIG. 18, an inner surface 114 of the gown flap 110 is exposed on the outside of the folded gown, while the outer surface 106 of the flap 110 is shielded beneath the folded flap.

Figure 17:
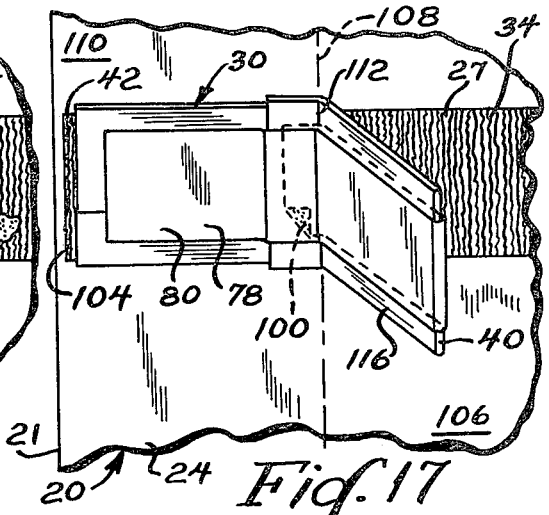
Figure 18:
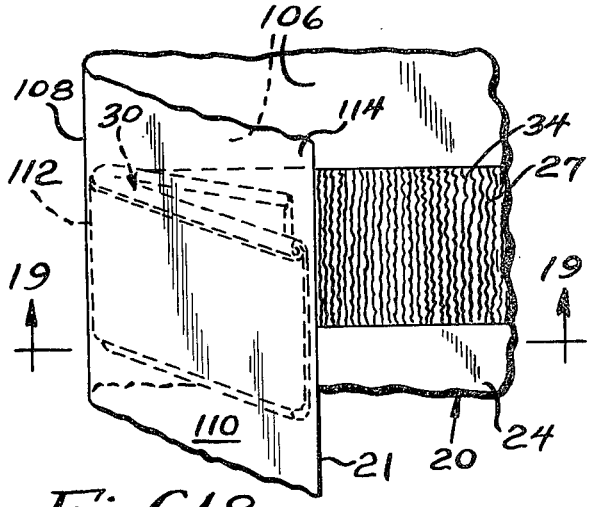
Figure 20:
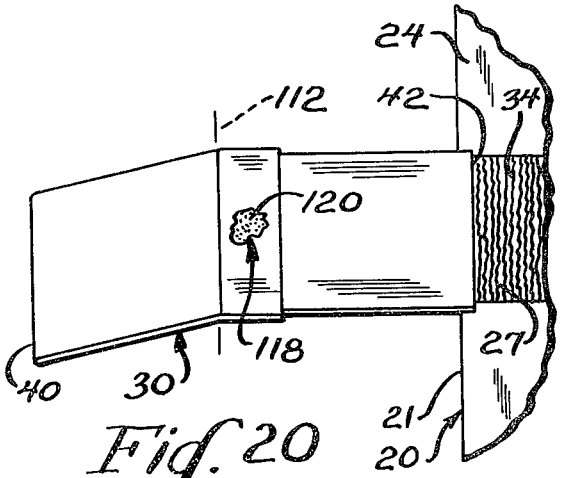
FIG. 20 is a fragmentary plan view illustrating another embodiment of the gown.
Figure 19:
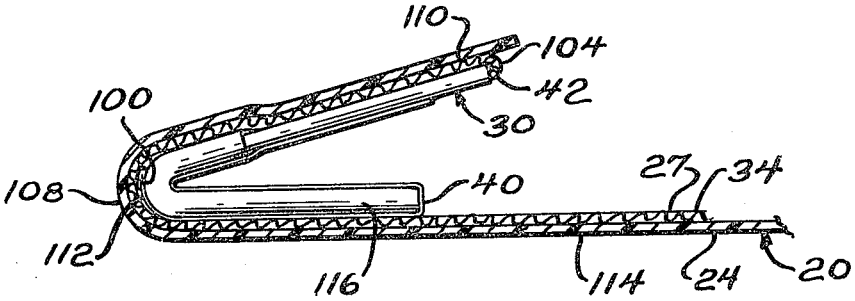
FIG. 19 is a fragmentary sectional view taken substantially as indicated along the line 19—19 of FIG. 18.

As illustrated in FIGS. 17–19, the length of the tab 116 is less than the width of the flap 110 intermediate the fold line 108 and side edge 21 of the gown, such that the entire protective member 30 is covered beneath the folded flap 110. Also, as shown in FIGS. 17 and 19, the attachment portion 100 of the tape strip 78 is preferably located intermediate the fold line 104 of the belt 27 and the fold lines 108 and 112 with the attachment portion 100 being shown located adjacent the fold line 108, such that the grasping tab 116 at the outer end of the protective member 30 is free of attachment to the garment. In an alternative form, such as for a belt assembly without a tape strip, the protective member 30 may be releasably attached by any suitable means 118, such as by a spot of adhesive 120, as shown in FIG. 20.

Referring to FIGS. 18 and 19, when the gown 20 is initially placed on the wearer, the folded protective flap 110 prevents contamination to the outer shielded surface 106 of the flap 110. Also, the attachment portion or adhesive 100 retains the protective member 30 in its covered position beneath the protective flap 110, thus preventing movement and contamination of the protective member 30 at this time. With reference to FIGS. 1 and 17–19, after the wearer places his arms in the arms of the gown 20, a nurse unfolds the flap 110 of the gown about the gown fold line 108 in order to close the opening 22 of the gown back 24 and expose the protective member 30 for subsequent use. At this time, the attachment portion 100 of the tape strip 78 retains the protective member 30 at its predetermined position, and prevents premature movement of the protective member against the shirt of the wearer prior to complete closure of the gown opening 22. Thus, the retaining means minimizes the possibility that the gown back will become contaminated by a non-sterile protective member. Once the opening 22 of the gown 20 has been closed by the flap 110, the tab 116 projects outwardly from the gown, and may be grasped by the non-sterile hand of the circulating nurse without contaminating the gown back. Thus, the nurse grasps and tugs the tab 116 of the protective member 30 in order to release the adhesive of the attachment portion 100 from the underlying part of the belt 27. Once the protective member has been released from the gown, the nurse draws the protective member around the wearer as previously described in connection with FIGS. 1–6. In this manner, the folded gown flap 110 and the releasable retaining means of the garment minimizes the possibility that the gown back may become contaminated during the placement procedure. As indicated above, it is desirable to maintain the gown back in a sterile condition, since a contaminated gown back may contact the sterile gown front of another person during the operation, thus rendering the gown front of the second person non-sterile. Of course, the gown fronts facing the patient must be sterile during the operation.

The foregoing detailed description is given for clearness of understanding only, and no unnecessary limitations should be understood therefrom, as modifications will be obvious to those skilled in the art.

I claim:

1. A disposable garment, comprising:

a sterile gown having a back, a pair of side edges defining an opening on the back of the gown;

an elongated belt having at least one end section for placement around said opening to close the gown about a wearer;

means for bonding a mid-portion of the belt on an outer surface of the gown in close proximity to one of said side edges;

a protective member removably positioned on and covering an outer end of said one end section to prevent contamination of the one end section while handling the belt; and means for releasably attaching the protective member against the garment adjacent said one side edge and preventing premature movement of the protective member relative the gown, said attaching means being separate from the bonding means and directly connecting an outer surface of the protective member against a surface of the garment.

2. The garment of claim 1 including means for releasably retaining the protective member on said outer end of the belt to prevent the protective member from prematurely slipping from the belt.

3. The garment of claim 1 wherein at least a portion of said end section is micropleated.

4. A disposable garment, comprising:

a sterile gown having an inner surface, an outer surface, a front, a back, a pair of side edges defining an opening on the back of the gown, and a protective flap defined by a fold line generally aligned with one of said side edges of the gown;

an elongated belt retained on the gown and extending toward said one side edge of the gown, said belt being folded back along a fold line adjacent said one side edge defining an end section of the belt;

a protective member removably positioned on and covering an outer end of said end section to prevent contamination of the end section while handling the belt; and means for releasably attaching a surface of the protective member against a surface of the garment at a location adjacent said one side edge intermediate opposed ends of the protective member and preventing premature movement of the protective member relative the gown and contamination of the protective member and gown back, said gown flap being folded with the outer surface of the flap facing the outer surface of the gown portion underlying the flap adjacent the gown fold line and covering said protective member.

5. The garment of claim 4 wherein the attaching means comprises adhesive located between the protective member and the garment.

6. The garment of claim 4 wherein said protective member includes a strip of pressure-sensitive tape attached to a surface of the retained protective member which faces the outer surface of the gown, and in which the attaching means comprises a folded back portion of said strip exposing adhesive for attachment to the garment.

7. The garment of claim 4 wherein the attaching means releasably attaches the protective member to an underlying portion of the belt.

8. The garment of claim 4 wherein said protective member includes a laterally extending fold line defining a grasping tab at an outer end of the protective member.

9. The garment of claim 4 wherein the retained protective member is located intermediate said flap and the underlying portion of the gown.

10. The garment of claim 9 wherein an inner end of said protective member is located adjacent said one side edge of the gown.

11. The garment of claim 4 wherein the attaching means is located intermediate said one side edge and fold line of the gown.

12. The garment of claim 4 wherein said protective member extends across the fold line of the gown, and in which the protective member includes a free grasping tab at an outer end of the protective member defined by a fold line generally aligned with the gown fold line.

13. The garment of claim 12 wherein the length of said tab between said fold line and an outer edge of the protective member is less than the width of said flap between said one side edge and the fold line of the gown.

14. A disposable garment, comprising:

a sterile gown having an inner surface, an outer surface, a front, a back, a pair of side edges defining an opening on the back of the gown, and a protective flap defined by a fold line generally aligned with one of said side edges, said flap being folded against an underlying portion of the gown with the outer surface of the flap facing the outer surface of the underlying portion of the gown;

an elongated belt having a central portion attached to the gown and a pair of end portions extending from said central portion for securing the gown about a wearer, with one of said belt end portions extending from said belt central portion toward the one side edge of the gown, and with said one belt end portion being folded back along a fold line located adjacent said one side edge of the gown and defining an end section of the belt;

a protecting member removably positioned on and covering an outer end of said belt end section to prevent contamination of the end section while handling the belt, said protective member being located between said flap and the underlying portion of the gown and having an inner edge located intermediate said one side edge and the fold line of the gown, said protective member having an outer edge, and a free grasping tab defined by a fold line generally aligned with the gown fold line; and means for releasably retaining the protective member against the garment to prevent premature movement of the protective member relative the gown and prevent contamination of the protective member and gown back.

15. The garment of claim 14 wherein the inner edge of the protective member is located adjacent said one side edge of the gown.

16. The garment of claim 14 wherein the retaining means is located intermediate said one side edge and fold line of the gown.

17. The garment of claim 16 wherein the retaining means is located adjacent the fold line of the gown.

18. The garment of claim 14 wherein the length of said tab is less than the width of the flap intermediate the one side edge and fold line of the gown.

* * * * *